US008391728B2

(12) United States Patent
Maruyama et al.

(10) Patent No.: US 8,391,728 B2
(45) Date of Patent: Mar. 5, 2013

(54) IMAGE FORMING APPARATUS AND VOLTAGE APPLYING DEVICE COMPRISING A CONTROL UNIT FOR CONTROLLING ANOTHER CONTROL UNIT WHEN THE OTHER CONTROL UNIT IS ABNORMALLY RESTARTED

(75) Inventors: Tsuyoshi Maruyama, Nagoya (JP); Masahito Hamaya, Nagoya (JP); Katsumi Inukai, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 448 days.

(21) Appl. No.: 12/727,757

(22) Filed: Mar. 19, 2010

(65) Prior Publication Data

US 2010/0278547 A1 Nov. 4, 2010

(30) Foreign Application Priority Data

Apr. 30, 2009 (JP) ..... 2009-110951

(51) Int. Cl.
*G03G 15/00* (2006.01)

(52) U.S. Cl. ..... 399/9; 399/31; 399/37

(58) Field of Classification Search ..... 399/9, 31, 399/37, 88, 89

See application file for complete search history.

(56) References Cited

U.S. PATENT DOCUMENTS 7,574,152 B2 * 8/2009 Ashikawa ..... 399/37

FOREIGN PATENT DOCUMENTS

| | | | |
|---|---|---|---|
| JP | 63221416 | A | 9/1988 |
| JP | 10243651 | A | 9/1998 |
| JP | 2000-010438 | | 1/2000 |
| JP | 2005218162 | A | 8/2005 |
| JP | 2005-249808 | | 9/2005 |
| JP | 2005-333450 | | 12/2005 |

* cited by examiner

*Primary Examiner* — William J Royer
(74) *Attorney, Agent, or Firm* — Banner & Witcoff, Ltd.

(57) ABSTRACT

An image forming apparatus includes a voltage applying unit for applying a voltage to an electric load; a sub control unit for controlling the voltage applying unit; a restarting unit for restarting the sub control unit in response to receipt of a restart signal; a determining unit for determining whether or not a restart of the sub control unit is an abnormal restart; and a main control unit. The main control unit generates a control start signal for allowing the voltage applying unit to start generation of the voltage, and the restart signal. When the determining unit determines that the restart of the sub control unit is an abnormal restart, the main control unit sends again the control start signal to the sub control unit.

17 Claims, 6 Drawing Sheets

IMAGE FORMING APPARATUS AND VOLTAGE APPLYING DEVICE COMPRISING A CONTROL UNIT FOR CONTROLLING ANOTHER CONTROL UNIT WHEN THE OTHER CONTROL UNIT IS ABNORMALLY RESTARTED

CROSS-REFERENCE TO RELATED APPLICATIONS

This non-provisional application claims priority under 35 U.S.C. §119(a) on Patent Application No. 2009-110951 filed in Japan on Apr. 30, 2009, the entire contents of which are hereby incorporated by reference.

TECHNICAL FIELD

The present invention relates to an image forming apparatus and a voltage applying device, and more particularly, it relates to control to be performed between two control units, such as a main control unit and a sub control unit, for controlling image formation by using the two control units.

BACKGROUND

A technique for control to be performed between two control units for controlling image formation is disclosed in, for example, Japanese Patent Application Laid-Open No. 2005-249808. According to the description of Japanese Patent Application Laid-Open No. 2005-249808, restart control means respectively for two control units (control means) are provided, so as to restart a second control unit (a sub control unit) by second restart control means for the second control unit when a first control unit (a main control unit) has run away. Specifically, when the main control unit has run away, the sub control unit is restarted, so as to prevent the sub control unit from being affected by the main control unit having run away.

SUMMARY

In the case where a restart signal is supplied to a control unit to be restarted from restart control means through a predetermined restart signal line, however, noise from, for example, a high voltage source may be superposed on the restart signal line. When noise is superposed on the restart signal line, it is apprehended that the control unit to be restarted may be abnormally restarted due to noise, no matter whether the other control unit is normal or abnormal. In particular, when a control unit for image formation is abnormally restarted during the image formation, resultant image quality may be degraded due to the abnormal restart of the control unit.

The present invention provides a technique to control degradation of image quality derived from abnormal restart of a control unit for image formation.

An image forming apparatus according to a first aspect is an image forming apparatus, comprising: an electric load for image formation; a voltage applying unit for generating a voltage and applying the generated voltage to the electric load; a transferring unit for transferring an image onto a recording medium by using the electric load to which the generated voltage is applied; a sub control unit for controlling an operation of the voltage applying unit; a restarting unit for restarting the sub control unit in response to receipt of a restart signal; a main control unit for generating a control start signal for allowing the voltage applying unit to start generation of a voltage and sending the generated control start signal to the sub control unit, and for generating the restart signal and sending the generated restart signal to the restarting unit; and a determining unit for determining whether or not restart of the sub control unit is an abnormal restart, wherein the main control unit sends again the control start signal to the sub control unit when the determining unit determines that restart of the sub control unit is an abnormal restart.

According to the first aspect, in the case where the sub control unit is abnormally restarted due to noise or the like when the sub control unit is normally operating, a control start signal is sent again to the sub control unit. Thus, the sub control unit may continue image forming processing in accordance with the control start signal sent again. Therefore, degradation of image quality otherwise caused due to the abnormal restart of the sub control unit, that is, a control unit for image formation, may be suitably controlled.

A voltage applying device according to a second aspect is a voltage applying device, comprising: a voltage applying unit for generating a voltage and applying the generated voltage to an electric load; a sub control unit for controlling an operation of the voltage applying unit; a restarting unit for restarting the sub control unit in response to receipt of a restart signal; a main control unit for generating a control start signal for allowing the voltage applying unit to start generation of a voltage and sending the generated control start signal to the sub control unit, and for generating the restart signal and sending the generated restart signal to the restarting unit; and a determining unit for determining whether or not restart of the sub control unit is an abnormal restart, wherein the main control unit sends again the control start signal to the sub control unit when the determining unit determines that restart of the sub control unit is an abnormal restart.

According to the second aspect, in the case where the sub control unit is abnormally restarted due to noise or the like when the sub control unit is normally operating, a control start signal is sent again to the sub control unit. Therefore, when the voltage applying device is used as a high voltage applying device for image forming processing, the sub control unit, that is, a control unit for image formation, may continue the image forming processing in accordance with the control start signal sent again. Accordingly, degradation of image quality otherwise caused due to the abnormal restart of the sub control unit may be suitably controlled.

According to the first and second aspects, the degradation of image quality derived from an abnormal restart of a control unit for image formation may be controlled.

The above and further objects and features will more fully be apparent from the following detailed description with accompanying drawings.

DETAILED DESCRIPTION

Embodiment 1

Embodiment 1 will now be described with reference to FIGS. 1 through 4.

1. Structure of Image Forming Apparatus

Figure 1:
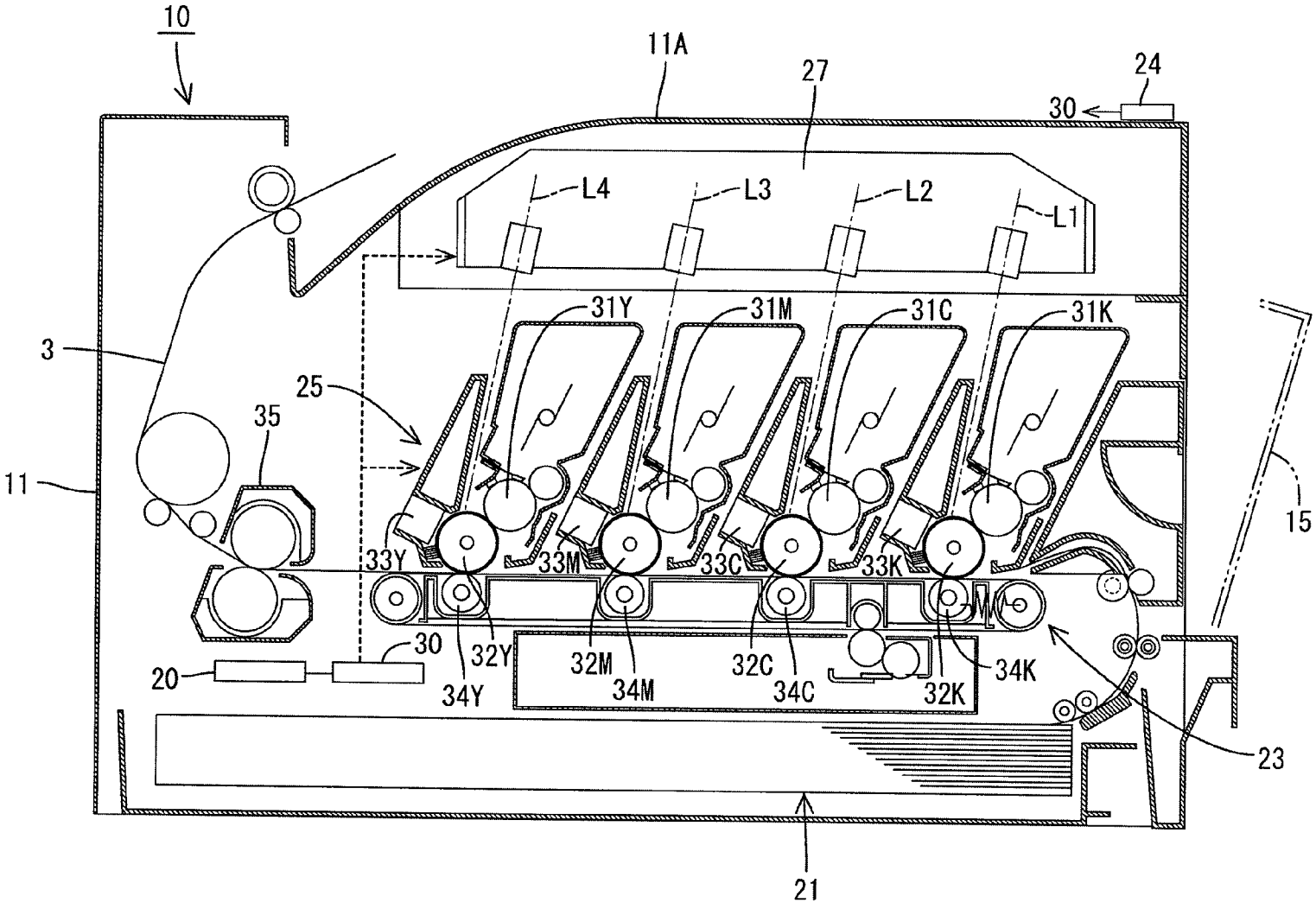
FIG. 1 is a side cross-sectional view schematically illustrating an internal structure of a laser printer according to Embodiment 1.

FIG. 1 is a side cross-sectional view schematically illustrating the structure of a principal part of an image forming apparatus according to Embodiment 1. Herein, an exemplary application of the image forming apparatus to a laser printer 10 will be described.

The laser printer 10 is what is called a direct tandem type color laser printer including four development rollers 31K, 31C, 31M and 31Y, four photosensitive drums 32K, 32C, 32M and 32Y, and the like respectively corresponding to four colors of black (K), cyan (C), magenta (M) and yellow (Y). It is noted that a front side mentioned in the following description indicates a right hand side in FIG. 1. Furthermore, the image forming apparatus is not limited to a color laser printer but may be, for example, a monochrome laser printer or an LED printer, or may be what is called a multifunction peripheral having a facsimile function and a copier function.

The laser printer (hereinafter simply referred to as the "printer") 10 includes a body casing 11 in the shape of a box. Within the body casing 11, a sheet feeding unit 21, a sheet conveying unit 23 for conveying a sheet 3 (corresponding to an example of a "recording medium"), an image forming unit 25 for forming an image by an electrophotographic method, and a scanning unit 27 are disposed to be stacked in this order in the upward direction.

Furthermore, a main board 20 and a high voltage board 30 are provided within the body casing 11. The main board 20 includes a main CPU 61 for controlling the respective units of the printer 10. The high voltage board 30 includes a high voltage CPU 62 controlled by the main CPU 61.

The image forming unit 25 includes the development rollers 31 (31K through 31Y), the photosensitive drums 32 (32K through 32Y), chargers 33 (33K through 33Y), transfer rollers (corresponding to an example of a "transferring unit") 34 (34K through 34Y), a fixer 35, and the like. The fixer 35 thermally fixes, on the sheet 3, a toner image having been transferred onto the sheet 3. Each charger 33 is what is called a scorotron type charger and includes a charging wire 33*a* and a grid electrode 33*b* (see FIG. 2).

Moreover, a front face of the body casing 11 works as an access port through which the image forming unit 25 is accessed, and a front cover 15 is rotatably provided thereon.

The scanning unit 27 includes polygon mirrors (not shown) and four laser diodes (not shown) respectively corresponding to the four colors. Laser beams L1 through L4 respectively emitted from the laser diodes are deflected by the polygon mirrors and then changed in their directions by optical components such as reflecting mirrors disposed on optical paths, so as to respectively irradiate the surfaces of the photosensitive drums 32 (32K through 32Y) for rapid scanning as illustrated in FIG. 1. As a result, a latent image is formed on each of the photosensitive drums 32 (32K through 32Y). Thereafter, an image is formed, through developing processing, transferring processing and fixing processing, on the sheet 3 having been conveyed through a sheet conveying path (not shown), and the resultant sheet 3 is discharged to a sheet output tray provided on an upper face wall 11A of the body casing 11.

2. Configuration of High Voltage Applying Device

Figure 2:
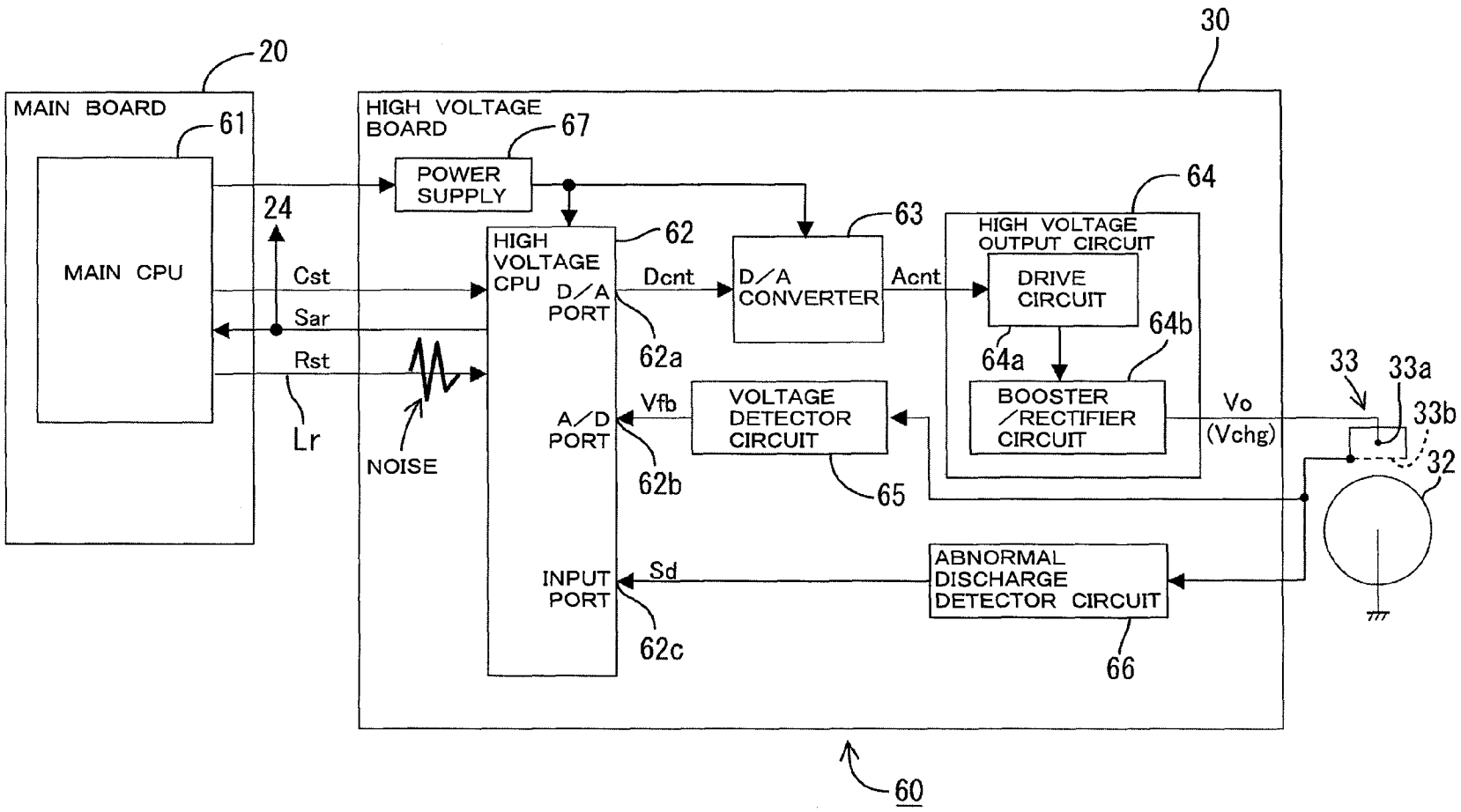
FIG. 2 is a schematic block diagram of a high voltage applying device of Embodiment 1.

Next, the circuit configuration of a high voltage applying device 60 will be described with reference to FIG. 2. In this embodiment, the high voltage applying device 60 is exemplarily provided in the printer 10.

The high voltage applying device 60 principally includes the main CPU (corresponding to an example of a "main control unit") 61, the high voltage CPU (corresponding to an example of a "sub control unit") 62, a D/A converter 63, a high voltage output circuit (corresponding to an example of a "voltage applying unit") 64, a voltage detector circuit (corresponding to a "voltage detecting unit") 65 and an abnormal discharge detector circuit 66. As illustrated in FIG. 2, for example, the main CPU 61 alone is provided on the main board 20 and the other components are provided on the high voltage board 30.

In this exemplary case, the high voltage output circuit 64 generates, for example, a charging voltage (corresponding to an example of a "voltage") Vchg to be applied to the charging wire 33*a* of the charger (corresponding to an example of an "electric load") 33. Incidentally, the voltage generated by the high voltage output circuit 64 is not limited to the charging voltage but the high voltage applying device 60 may be applied to a case where, for example, the high voltage output circuit 64 generates a transferring voltage to be applied to the transfer roller 34. The high voltage output circuit 64 includes, for example, a drive circuit 64*a* and a booster/rectifier circuit 64*b*. The booster/rectifier circuit 64*b* includes, for example, a boosting transformer, and the drive circuit 64*a* drives a primary side of the boosting transformer.

The main CPU 61 generates a control start signal Cst for allowing the high voltage output circuit 64 to start generation of the charging voltage Vchg and sends the control start signal Cst to the high voltage CPU 62. Also, the main CPU 61 generates a restart signal Rst and sends the restart signal Rst to the high voltage CPU (corresponding to an example of a "restarting unit") 62 through a restart line Lr. The high voltage CPU 62 is restarted in response to receipt of the restart signal Rst. In other words, the high voltage CPU 62 is started in response to the receipt of the restart signal Rst. The main CPU 61 generates the restart signal Rst when, for example, power is supplied to the printer 10 or the front cover 15 is closed, so as to normally restart the high voltage CPU 62 on the basis of the restart signal Rst.

The high voltage CPU 62 generates a digital control signal (corresponding to an example of a "control value") Dcnt used for controlling the high voltage output circuit 64 in response to the control start signal Cst. The high voltage CPU 62 supplies the digital control signal Dcnt to the D/A converter 63 through a D/A port 62*a*. The D/A converter 63 converts the digital control signal Dcnt into an analog control signal Acnt and supplies the analog control signal Acnt to the drive circuit 64*a* of the high voltage output circuit 64. The drive circuit 64*a* drives, for example, the primary side of the boosting transformer of the booster/rectifier circuit 64*b* in accordance with the analog control signal Acnt.

Furthermore, the high voltage CPU (corresponding to an example of a "determining unit") 62 determines whether its own restart is a regular restart (normal restart) in accordance with the restart signal Rst or an abnormal restart derived from, for example, noise superposed on the restart line Lr. When the high voltage CPU 62 determines that the restart is an abnormal restart, it generates an abnormal restart detection signal Sar and sends the abnormal restart detection signal Sar to the main CPU 61 and a liquid crystal monitor (corresponding to an example of a "reporting unit") 24 provided on the body casing 11.

When the main CPU 61 receives the abnormal restart detection signal Sar, it sends again the control start signal Cst to the high voltage CPU 62. Thus, in Embodiment 1, the control start signal Cst is sent again to the high voltage CPU 62, so that the high voltage CPU 62 may continue image formation while controlling degradation of image quality otherwise caused by the abnormal restart even when the high voltage CPU 62 is abnormally restarted during the image formation.

Furthermore, when the liquid crystal monitor 24 receives the abnormal start detection signal Sar, the liquid crystal monitor 24 displays a message for reporting a method for removing a cause of the abnormal restart so as to urge a user to remove the cause of the abnormal restart. The liquid crystal monitor 24 displays a message of, for example, "Please move an external noise source away from the printer." or "Please earth the printer". It is noted that the liquid crystal monitor 24 reporting the method for removing a cause of the abnormal restart in accordance with the abnormal restart detection signal Sar may be arbitrarily employed and may be omitted.

The voltage detector circuit 65 detects a voltage Vfb in accordance with the charging voltage Vchg and supplies the detected voltage Vfb to an A/D port 62*b* of the high voltage CPU 62. When a restart time voltage Vrfb detected by the voltage detector circuit 65 immediately after starting the high voltage CPU 62 through some restart has a value other than zero, the high voltage CPU 62 determines that the restart is not a regular restart (normal restart) but an abnormal restart. This is for the following reason.

In general, when the high voltage CPU 62 is normally restarted, the control of the high voltage output circuit 64 by the high voltage CPU 62 is halted, namely, the generation of the charging voltage Vchg by the high voltage output circuit 64 is halted, before restarting the high voltage CPU 62. In an abnormal restart of the high voltage CPU 62, however, the generation of the charging voltage Vchg by the high voltage output circuit 64 is not halted, and hence, a voltage derived from this voltage generation is detected by the voltage detector circuit 65. The voltage detected at this point may be a voltage derived from, for example, counter electromotive force of the boosting transformer of the booster/rectifier circuit 64*b* or charge of a rectifier capacitor. Therefore, when the voltage Vfb having a value other than zero is detected by the voltage detector circuit 65, it may be determined that the restart is not a normal restart but an abnormal restart.

Furthermore, when the restart is determined to be an abnormal restart, in order to prevent the charging voltage Vchg from having an abnormal value, the high voltage CPU 62 sets a temporary target voltage Vptg of the charging voltage Vchg on the basis of the restart time voltage Vrfb detected by the voltage detector circuit 65.

The abnormal discharge detector circuit 66 is connected to the grid electrode 33*b* of the charger 33 so as to periodically check abnormal discharge caused when the charging voltage Vchg is applied to the charger 33. When the abnormal discharge is detected, the abnormal discharge detector circuit 66 generates an abnormal discharge detection signal Sd and supplies the abnormal discharge detection signal Sd to an input port 62*c* of the high voltage CPU 62. At this point, the abnormal discharge detector circuit 66 is provided for the following reason.

When the charger 33 is used, for example, for a long period of time, silica, dust or the like is adhered to the charging wire 33*a* (which phenomenon corresponds to what is called wire thickening), resulting in increasing the impedance of the charging wire 33*a*. In this case, when constant current control is performed on a grid current passing through the grid electrode 33*b* as described later, the charging voltage Vchg is increased. When the charging voltage Vchg is increased beyond a predetermined value, abnormal discharge is caused between the charging wire 33*a* and the grid electrode 33*b*, so as to allow a large amount of current to pass therebetween. As a result, the photosensitive drum 32 cannot be uniformly charged, and hence, it is apprehended that the resultant image quality may be degraded. Therefore, it is necessary to find abnormal discharge at an early stage by the abnormal discharge detector circuit 66.

Moreover, a power supply 67 supplies power to the high voltage CPU 62 and its peripheral circuit, that is, the D/A converter 63. It is noted that the operation of the power supply 67 is controlled by the main CPU 61. When the high voltage CPU 62 is to be normally restarted, the main CPU 61 may normally restart the high voltage CPU 62 by disconnecting the power supply 67 from the high voltage CPU 62 and the peripheral circuit instead of generating the restart signal Rst.

Incidentally, in general image formation, the high voltage CPU 62 controls the high voltage output circuit 64 for allowing it to output a constant current on the basis of, for example, the voltage Vfb detected by the voltage detector circuit 65, so as to make constant a grid current obtained by applying the charging voltage Vchg. In this case, the voltage detector circuit 65 specifically includes, for example, a voltage dividing resistor, so as to detect, with the voltage dividing resistor, a divided value of a grid voltage to be applied to the grid electrode 33*b* in accordance with the charging voltage Vchg. Specifically, the voltage Vfb corresponds to the divided value of the grid voltage. It is noted that the voltage Vfb is not limited to the divided value. For example, the voltage detector circuit 65 may include an auxiliary coil connected to the primary side of the boosting transformer of the booster/rectifier circuit 64*b*, and the voltage Vfb may be a voltage detected by the auxiliary coil in accordance with the charging voltage Vchg.

Furthermore, although the high voltage applying device 60 is provided in the printer 10 in this embodiment, the application of the high voltage applying device 60 is not limited to the printer. The high voltage applying device 60 is applicable to any apparatus as far as it utilizes a high voltage and there arises a problem when the high voltage CPU 62 is abnormally restarted.

3. Control to be Performed in Restart

Figure 3:
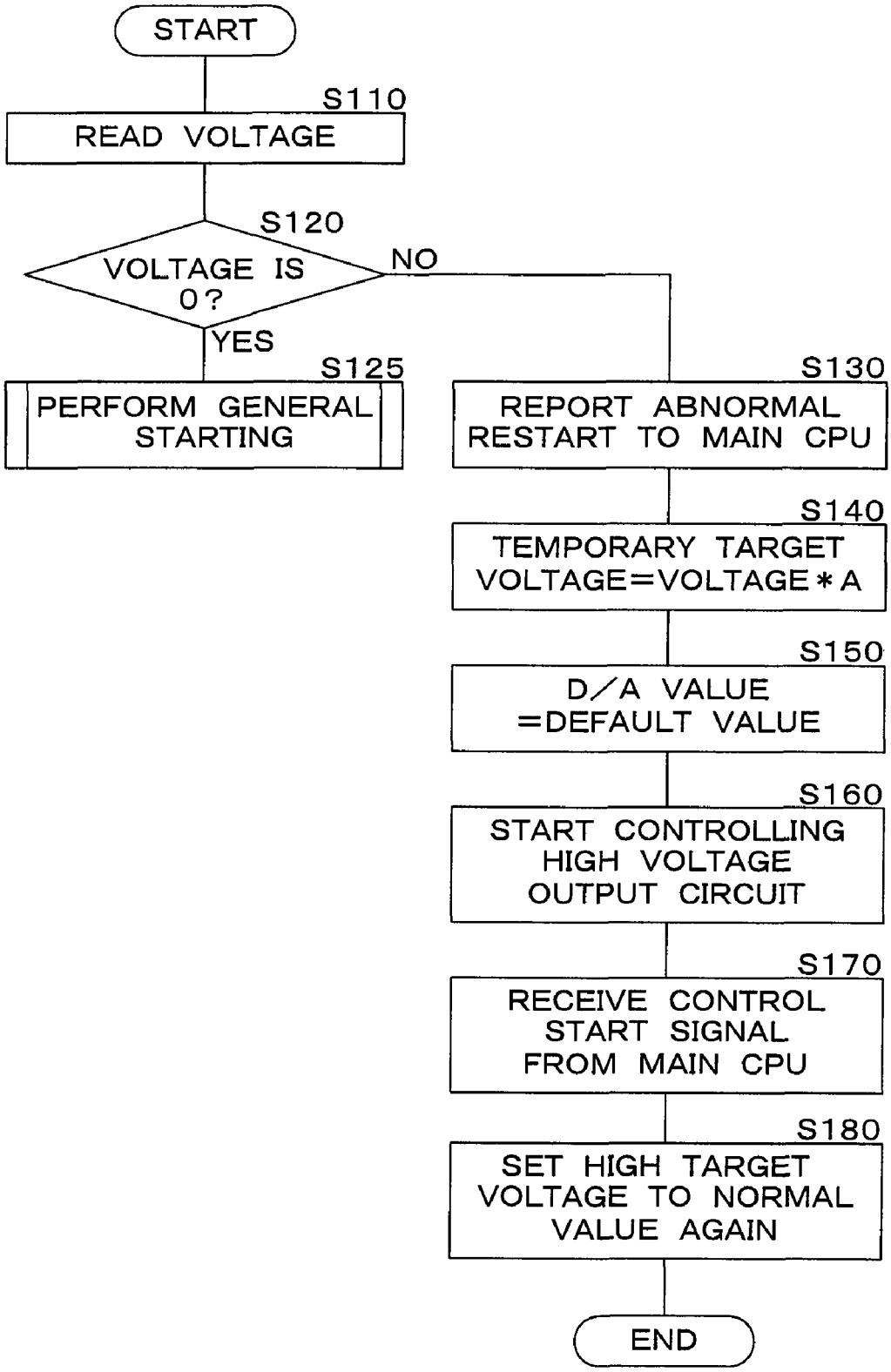
FIG. 3 is a flowchart illustrating processing performed at the time of restart of a high voltage CPU.
Figure 4:
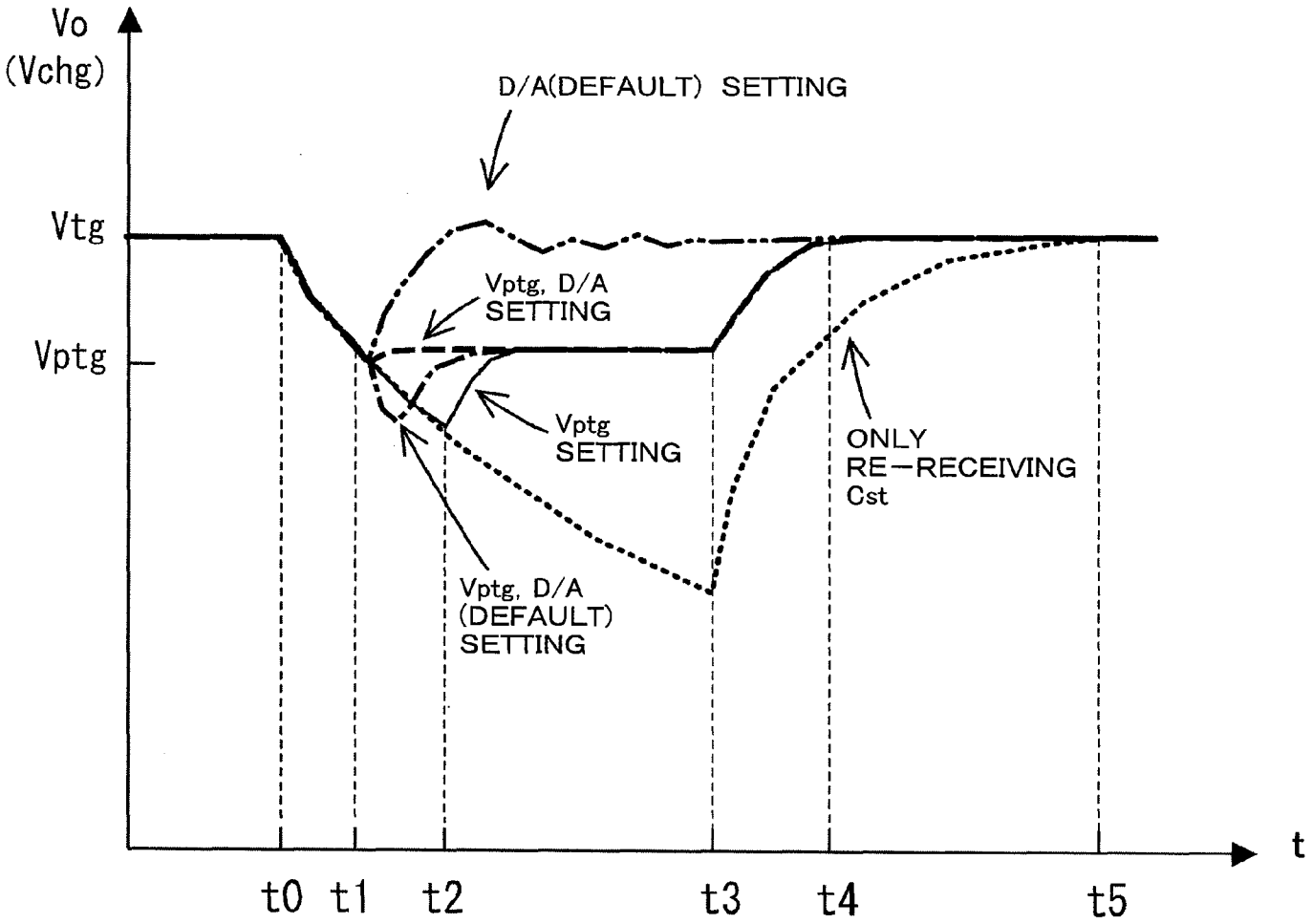
FIG. 4 is a time chart schematically illustrating change in a voltage output at the time of abnormal restart of the high voltage applying device.

Next, the control to be performed at the time of abnormal restart of the high voltage CPU 62 in Embodiment 1 will be described with reference to FIGS. 3 and 4. FIG. 3 is a flowchart illustrating processing performed at the time of restart. FIG. 4 is a time chart schematically illustrating change in the charging voltage Vchg (i.e., a high voltage output Vo) at the time of restart. It is assumed in FIG. 4 that the abnormal restart is caused at time t0. The processing performed at the time of restart is executed by the high voltage CPU 62 in accordance with, for example, a predetermined program when the high voltage CPU 62 is started through some restart.

In step S110 of FIG. 3, the high voltage CPU 62 reads a restart time voltage Vrfb from the voltage detector circuit 65 immediately after the restart (which procedure corresponds to the time t0 of FIG. 4). Then, the high voltage CPU 62 determines whether or not the read restart time voltage Vrfb is "0" (step S120). When it is determined that the restart time voltage Vrfb is "0", the restart is a normal restart, and hence, the processing proceeds to step S125, where the high voltage CPU 62 performs a general starting operation. In the general starting operation, the high voltage CPU 62 performs its own initialization and waits for receipt of a control start signal Cst supplied from the main CPU 61.

On the other hand, when it is determined that the restart time voltage Vrfb is not "0", the high voltage CPU 62 determines that the restart is an abnormal restart, and the processing proceeds to step S130. In step S130, the high voltage CPU 62 sends an abnormal restart detection signal Sar to the main CPU 61 and the liquid crystal monitor 24, and in step S140, the high voltage CPU 62 sets a temporary target voltage Vptg, that is, a temporary target output voltage to be attained after abnormal restart, to a value obtained by multiplying the restart time voltage Vrfb read in step S110 by a predetermined value "A". It is noted that the temporary target voltage Vptg is preferably set to a value lower than a normal high target voltage Vtg as illustrated in FIG. 4 in order to prevent the charging voltage Vchg from having an abnormal value exceeding the target voltage Vtg. Furthermore, the predetermined value "A" is a constant defined depending upon the high voltage output circuit 64 and the voltage detector circuit 65. In this embodiment, the predetermined value "A" is, for example, 200.

In step S150, a D/A value, that is, a value of a digital control signal Dcnt, is set to a default value (corresponding to an example of a "predetermined value"). The default value is a predetermined value set as the D/A value to be employed at the time of abnormal restart and is, for example, a value corresponding to the temporary target voltage Vptg or a D/A value to be attained in a normal operation of the high voltage output circuit 64. In step S160, the high voltage CPU 62 starts controlling the high voltage output circuit 64.

It is noted that procedures in steps S130 through S150 are performed substantially simultaneously at time t1 of FIG. 4. Thus, the high voltage output Vo of the high voltage output circuit 64, namely, the charging voltage Vchg, stops decreasing derived from the abnormal restart as illustrated with an alternate long and short dash line in FIG. 4, so as to be temporarily kept at a substantially constant value of the temporary target voltage Vptg.

Subsequently, in step S170, the high voltage CPU 62 receives again the control start signal Cst from the main CPU 61. In step S180, the high voltage CPU 62 sets the high target voltage (hereinafter referred to as the "target voltage") Vtg to a normal value again in accordance with the control start signal Cst and starts controlling the high voltage output circuit 64 in accordance with the control start signal Cst (which procedure corresponds to time t3 of FIG. 4). Thus, the charging voltage Vchg reaches the target voltage Vtg substantially at time t4 of FIG. 4.

It is noted that the procedure of step S140 may be omitted in the processing of FIG. 3. Specifically, the procedure of step S150 for setting a D/A value alone may be performed as temporary processing to be performed at the time of abnormal restart. The change in the charging voltage Vchg caused in this case is illustrated with an alternate long and two short dashes line in FIG. 4. In this case, a default value of the D/A value is, for example, the D/A value employed in the normal operation of the high voltage output circuit 64, namely, a value corresponding to the target voltage Vtg. In this case, since the temporary target voltage Vptg is not set, the charging voltage Vchg is varied (rippled) in the vicinity of the target voltage Vtg as illustrated in FIG. 4. In this case, however, the charging voltage Vchg reaches the target voltage Vtg after the abnormal restart of the high voltage CPU 62 more rapidly than in the case where the temporary target voltage Vptg is set (see FIG. 4).

Furthermore, the procedure of step S150 may be omitted in the processing of FIG. 3. Specifically, the procedure of step S140 for setting the temporary target voltage Vptg alone may be performed as the temporary processing to be performed at the time of abnormal restart. The change in the charging voltage Vchg caused in this case is illustrated with a solid line in FIG. 4. In this case, the D/A value is not set to a default value but to a value in accordance with an operation performed at the time of normal start. For example, the D/A value is set to a value to be successively increased for increasing the charging voltage Vchg. Therefore, the charging voltage Vchg is reduced, for example, until time t2 of FIG. 4 in this case.

Moreover, the procedures of steps S140 through S160 may be omitted in the processing of FIG. 3. The change in the charging voltage Vchg caused in this case is illustrated with a dotted line in FIG. 4. Also in this case, when the high voltage CPU 62 is abnormally restarted, the high voltage CPU 62 may start controlling the high voltage output circuit 64 in accordance with the control start signal Cst sent again, at time t3 of FIG. 4. Therefore, the charging voltage Vchg may reach the target voltage Vtg substantially at time t5 of FIG. 4.

4. Effects of Embodiment 1

As described so far, in Embodiment 1, when the high voltage CPU 62 is abnormally restarted due to noise or the like during a normal operation of the high voltage CPU 62, the control start signal Cst is sent again to the high voltage CPU 62. The high voltage CPU 62 may continue the image forming processing in accordance with the control start signal Cst thus sent again. Therefore, degradation of image quality otherwise caused due to abnormal restart of the high voltage CPU 62, that is, a control unit for image formation, may be suitably controlled.

Furthermore, when the high voltage CPU 62 is restarted (started), it is determined, in accordance with the restart time voltage Vrfb detected by the voltage detector circuit 65 immediately after the restart, whether the restart is a normal restart or an abnormal restart derived from noise or the like. At this point, when the high voltage CPU 62 detects the restart time voltage Vrfb having a value other than "0", the high voltage CPU 62 may suitably make self-determination for the abnormal restart.

When the restart is determined to be an abnormal restart, the high voltage CPU 62 performs the temporary processing for keeping the output of the charging voltage Vchg before receiving the control start signal Cst from the main CPU 61. As the temporary processing, the temporary target voltage Vptg not more than the target voltage Vtg is set on the basis of the restart time voltage Vrfb, and the D/A value is set on the basis of the predetermined value. Therefore, the charging voltage Vchg may be prevented from having an abnormal value exceeding the target voltage Vtg during the temporary processing.

Moreover, as illustrated in FIG. 4, after the abnormal restart of the high voltage CPU 62, the charging voltage Vchg may more rapidly reach the target voltage Vtg (see time t4) than in the case where the temporary processing is not performed (see time t5).

Embodiment 2

An image forming apparatus according to Embodiment 2 will now be described with reference to FIGS. 5 and 6.

Embodiment 2 is different from Embodiment 1 in a high voltage applying device alone, and hence, the high voltage applying device alone will be herein described. Furthermore, like reference numerals are used to refer to like elements used in Embodiment 1 and like step numbers are used to refer to like procedures performed in Embodiment 1, so as to omit the description. FIG. 5 is a block circuit diagram schematically illustrating a high voltage applying device 60A of Embodiment 2. FIG. 6 is a flowchart illustrating processing to be performed for restart in Embodiment 2.

Figure 5:
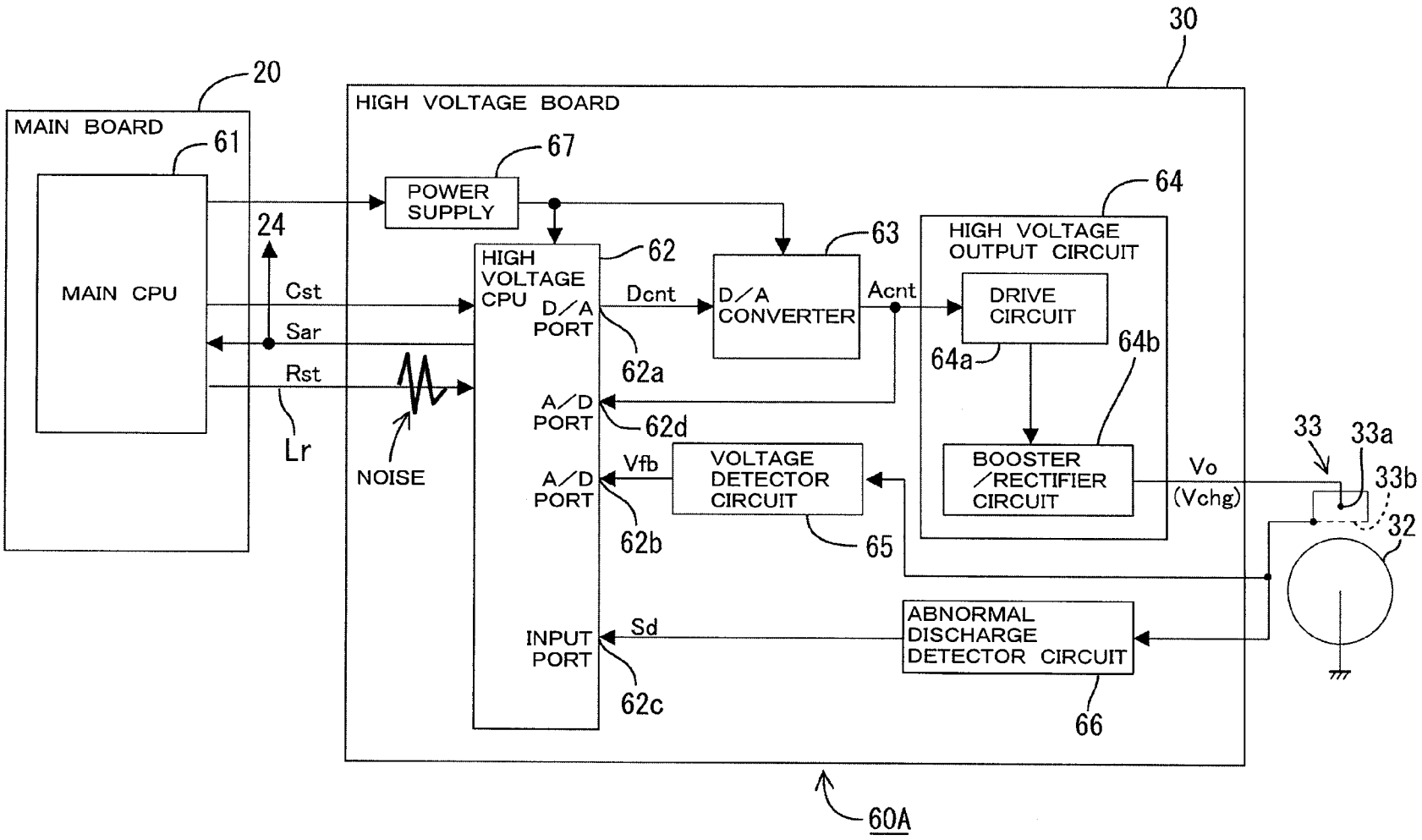
FIG. 5 is a schematic block diagram of a high voltage applying device according to Embodiment 2.

As illustrated in FIG. 5, in the high voltage applying device 60A of Embodiment 2, a high voltage CPU (corresponding to an example of a "control value detecting unit") 62 detects, through an A/D port 62*d*, a value (a DA voltage value or a control value) of an analog control signal Acnt corresponding to an output of a D/A converter 63. It is noted that the value of the analog control signal Acnt is latched by the D/A converter 63 during normal control of a high voltage output circuit 64 and is reset to zero when the high voltage CPU 62 is normally restarted. The high voltage CPU 62 determines whether or not restart is an abnormal restart on the basis of a restart time analog control signal (a DA voltage; corresponding to an example of a "restart time control value") detected at the time of restart.

Figure 6:
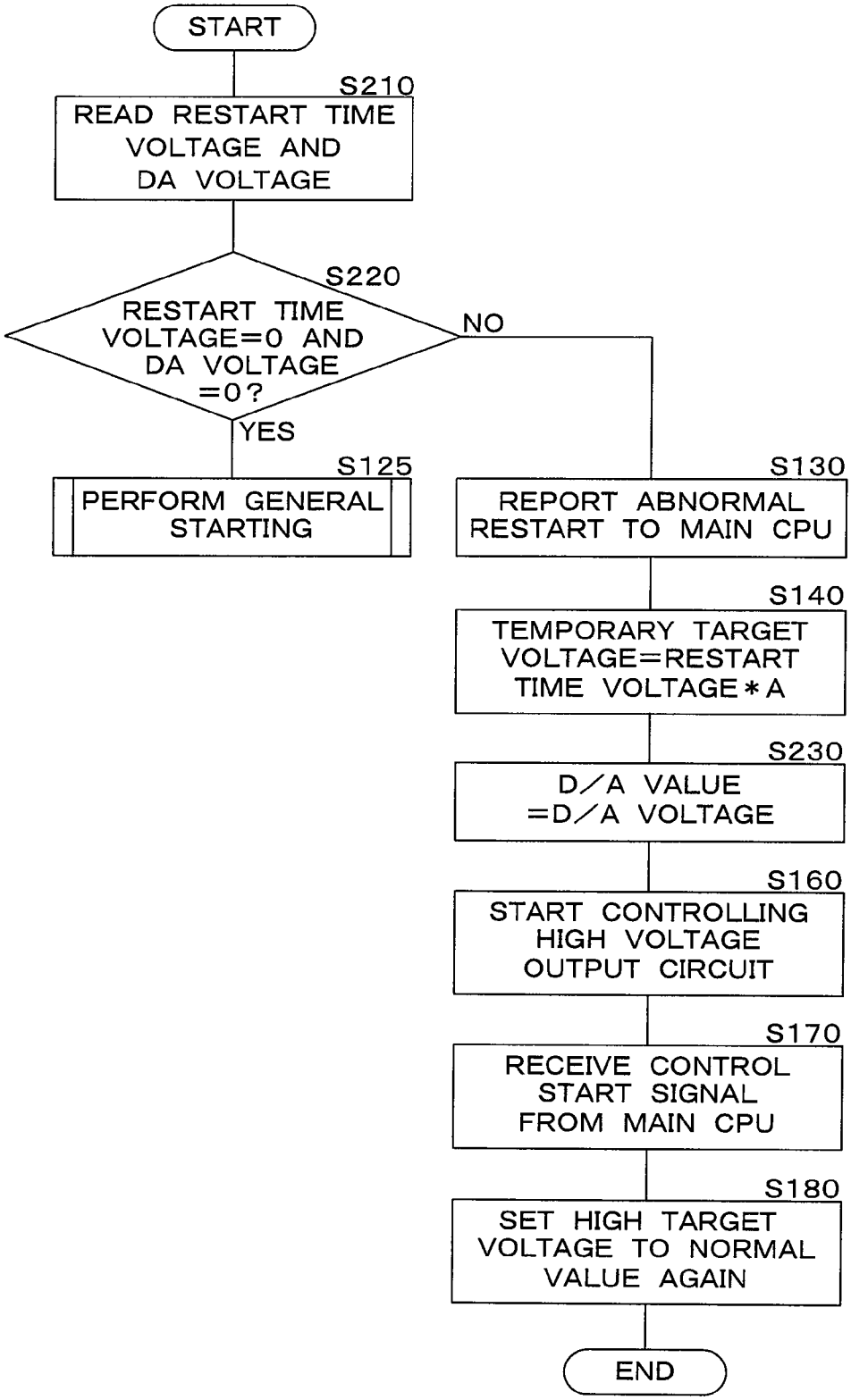
FIG. 6 is a flowchart illustrating processing performed at the time of restart of a high voltage CPU according to Embodiment 2.

Specifically, when the high voltage CPU 62 is started through some restart in step S210 of FIG. 6, a restart time voltage Vrfb is read from a voltage detector circuit 65 immediately after the start, and a restart time DA voltage Arcnt is read from the D/A converter 63 (which procedure corresponds to time t0 of FIG. 4). In step S220, it is determined whether or not the restart time voltage Vrfb and the restart time DA voltage Arcnt thus read are both "0". When it is determined that the restart time voltage Vrfb and the restart time DA voltage Arcnt are both "0", the restart is a normal restart, and hence, the processing proceeds to step S125, where the high voltage CPU 62 performs a normal starting operation.

On the other hand, when one of the restart time voltage Vrfb and the restart time DA voltage Arcnt is not "0" (i.e., "NO" in step S220), the high voltage CPU 62 determines that the restart is an abnormal restart and performs the aforementioned procedures following step S130. At this point, the procedure of step S150 is replaced with a procedure of step S230 in Embodiment 2.

Specifically, in step S230, the high voltage CPU 62 sets a D/A value to a value of the restart time DA voltage Arcnt read in S210 instead of the "default (predetermined) value". In other words, when the high voltage CPU 62 is abnormally restarted, the value of the DA voltage latched by the D/A converter 63 (i.e., the restart time control value) is set as the D/A value. The change in a charging voltage Vchg caused in this case is illustrated with a broken line in FIG. 4.

In this manner, in Embodiment 2, the D/A value is set to a value of the restart time DA voltage Arcnt as the temporary processing to be performed at the time of an abnormal restart. Accordingly, as illustrated with the broken line in FIG. 4, the charging voltage Vchg may be made to reach a temporary target voltage Vptg more accurately and more rapidly than in Embodiment 1 (illustrated with the alternate long and short dash line in FIG. 4). Furthermore, the high voltage CPU 62 may suitably make self-determination for the abnormal restart by detecting that one of the restart time voltage Vrfb and the restart time DA voltage Arcnt has a value other than "0".

It is determined that the restart is an abnormal restart when the restart time DA voltage Arcnt has a value other than "0" for the following reason. In general, when the high voltage CPU 62 is normally restarted, the control of the high voltage output circuit 64 by the high voltage CPU 62 is halted, namely, a value of a control signal Dcnt is set to zero by halting generation of the control signal Dcnt, before restarting the high voltage CPU 62 as described above. At the time of abnormal restart of the high voltage CPU 62, however, the value of an analog control signal (i.e., the DA voltage) Acnt is latched by the D/A converter 63. Therefore, it may be determined in accordance with the value of the restart time DA voltage Arcnt whether or not the restart is abnormal.

Alternative Embodiments

The present invention is not limited to the embodiments described above and illustrated in the accompanying drawings, but embodiments described below are also embraced in the technical scope of the invention, and furthermore, the invention may be practiced through various modifications made without departing from the scope of the invention.

(1) In each of the aforementioned embodiments, when it is determined that the restart is an abnormal restart, the high voltage CPU 62 may not allow the peripheral circuit such as the D/A converter 63 to be restarted. In this case, restarting time necessary after the abnormal restart of the high voltage CPU 62 may be reduced.

(2) In each of the aforementioned embodiments, when it is determined that the restart is an abnormal restart, the high voltage CPU 62 may decrease the target voltage Vtg of the charging voltage Vchg. This is for the following reason. A high voltage of several kV is generally applied to the charger 33, and noise tends to be caused by the high voltage. When abnormal discharge is caused in the charger 33, for example, it seems that the abnormal restart of the high voltage CPU 62 is highly probably caused due to noise of the abnormal discharge. Therefore, when the target voltage Vtg of the charging voltage Vchg is decreased, occurrence of abnormal discharge related to the abnormal restart may be controlled. When it is determined that the restart is an abnormal restart, the target voltage Vtg of the charging voltage Vchg may be set to, for example, 80% of a generally set value.

(3) In each of the aforementioned embodiments, when it is determined that the restart is an abnormal restart, the high voltage CPU 62 may shorten a detection cycle of the detection performed by the abnormal discharge detector circuit 66. This is for the following reason. When the detection cycle for abnormal discharge is shortened, detection of abnormal discharge may be advanced. Therefore, the correlation between abnormal discharge and abnormal restart may be checked earlier, so as to control the occurrence of abnormal discharge related to the abnormal restart. When it is determined that the restart is an abnormal restart, the detection cycle for abnormal discharge may be shortened from a general cycle of 10 ms to, for example, 1 ms.

(4) In each of the aforementioned embodiments, the main CPU 61 may disconnect the power supply 67 instead of generating the restart signal Rst in normally restarting the high voltage CPU 62. In this case, the high voltage CPU 62 (i.e., the sub control unit) and its peripheral circuit may be definitely normally restarted as well as normal restart may be easily distinguished from abnormal restart.

(5) Although the high voltage CPU 62 corresponds to the restarting unit, the determining unit and the control value detecting unit of this invention in each of the aforementioned embodiments, the configuration is not limited to this. Instead, at least one of the restarting unit, the determining unit and the control value detecting unit may be provided separately from the high voltage CPU 62.

(6) In Embodiment 2, although it is determined, on the basis of the restart time voltage Vrfb and the restart time DA voltage Arcnt, whether or not the restart is an abnormal restart, the invention is not limited to this. For example, it may be determined in step S220 whether or not the restart is an abnormal restart on the basis of the restart time DA voltage Arcnt alone. Also in this case, the high voltage CPU 62 may suitably make self-determination for an abnormal restart by detecting the restart time DA voltage Arcnt having a value other than "0". It is noted that the restart time DA voltage (i.e., the restart time control value) Arcnt should not be always a voltage obtained immediately after an abnormal restart as far as it is a voltage obtained after the abnormal restart.

Effects of the Embodiments

In general, when the sub control unit is normally restarted (namely, at the time of normal restart), the control of the voltage applying unit by the sub control unit is halted, namely, the generation of the voltage by the voltage applying unit is halted, before restarting the sub control unit. At the time of an abnormal restart of the sub control unit, however, the generation of the voltage by the voltage applying unit is not halted, and hence, a voltage derived from this voltage generation is detected by the voltage detecting unit. Therefore, according to this embodiment, it is suitably determined whether or not the restart is an abnormal restart depending upon a voltage detected by the voltage detecting unit at the time of the restart (i.e., the restart time voltage).

According to this embodiment, when the sub control unit is abnormally restarted, the temporary voltage corresponding to a temporary target voltage for the voltage applying unit to be set at the time of abnormal restart is set on the basis of the voltage detected at the time of the abnormal restart. Therefore, the voltage applying unit may be prevented from supplying a voltage with an abnormal value otherwise caused when the voltage applying unit cannot be normally controlled due to the abnormal restart.

According to this embodiment, when the sub control unit is abnormally restarted, the control value is set to a predetermined value set for the abnormal restart. Therefore, when the predetermined value is set to, for example, a value corresponding to a temporary voltage or a target voltage for the voltage applying unit, the voltage attained at the time of abnormal restart of the sub control unit may be allowed to more rapidly rise than in the case where the control value is varied depending upon the output voltage of the voltage applying unit.

In general, when the sub control unit is normally restarted, the control of the voltage applying unit by the sub control unit is halted, namely, the control value is set to zero by halting the generation of the voltage by the voltage applying unit, before restarting the sub control unit. In the abnormal restart of the sub control unit, however, the generation of the control value is not halted, and hence, a control value derived from this is detected by the control value detecting unit. Therefore, according to this embodiment, it is suitably determined whether or not the restart is an abnormal restart depending upon a control value detected at the time of an abnormal restart.

According to this embodiment, when the sub control unit is abnormally restarted, the control value is set on the basis of a control value obtained at the time of the abnormal restart. Therefore, the voltage may reach the temporary voltage more definitely and more rapidly than in the case where the control value is set to a predetermined value.

According to the embodiment, restarting time necessary after the abnormal restart of the sub control unit may be reduced.

In general, a high voltage of several kV is applied to a charging unit of an image forming apparatus, and noise tends to be caused by the high voltage. When abnormal discharge is caused in the charging unit, for example, it seems that abnormal restart is highly probably caused by noise of the abnormal discharge. Therefore, occurrence of abnormal discharge related to abnormal restart may be controlled in this embodiment by decreasing the voltage (i.e., the charging voltage).

According to this embodiment, when the detection cycle for abnormal discharge is shortened, the detection of the abnormal discharge may be advanced. Therefore, the correlation between abnormal discharge and abnormal restart may be checked earlier, so as to control the occurrence of abnormal discharge related to abnormal restart.

According to this embodiment, a user may be urged to remove the cause of the abnormal restart.

According to this embodiment, the sub control unit and its peripheral circuit may be definitely restarted at the time of normal restart, and normal restart and abnormal restart may be easily distinguished from each other.

As this description may be embodied in several forms without departing from the spirit of essential characteristics thereof, the present embodiments are therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. An image forming apparatus, comprising:

an electric load for image formation;

a voltage applying unit for generating a voltage and applying the generated voltage to the electric load;

a transferring unit for transferring an image onto a recording medium by using the electric load to which the generated voltage is applied;

a sub control unit for controlling an operation of the voltage applying unit;

a restarting unit for restarting the sub control unit in response to receipt of a restart signal;

a main control unit for generating a control start signal for allowing the voltage applying unit to start generation of a voltage and sending the generated control start signal to the sub control unit, and for generating the restart signal and sending the generated restart signal to the restarting unit; and a determining unit for determining whether or not a restart of the sub control unit is an abnormal restart, wherein the main control unit sends again the control start signal to the sub control unit when the determining unit determines that the restart of the sub control unit is an abnormal restart.

2. The image forming apparatus according to claim 1, further comprising a voltage detecting unit for detecting a voltage output from the voltage applying unit, wherein the determining unit determines that the restart of the sub control unit is an abnormal restart when a restart time voltage detected by the voltage detecting unit after the sub control unit is restarted by the restarting unit has a value other than zero.

3. The image forming apparatus according to claim 2, wherein the sub control unit sets a temporary voltage for the voltage applying unit on the basis of the restart time voltage when the determining unit determines that the restart of the sub control unit is an abnormal restart.

4. The image forming apparatus according to claim 1, wherein the sub control unit generates a control value for controlling the operation of the voltage applying unit, and the sub control unit sets the generated control value to a predetermined value when the determining unit determines that the restart of the sub control unit is an abnormal restart.

5. The image forming apparatus according to claim 1, wherein the sub control unit generates a control value for controlling the operation of the voltage applying unit, the image forming apparatus further comprises a control value detecting unit for detecting the control value, and the determining unit determines that the restart of the sub control unit is an abnormal restart when a restart time control value detected by the control value detecting unit after the sub control unit is restarted by the restarting unit is a value other than zero.

6. The image forming apparatus according to claim 5, wherein the sub control unit sets the generated control value to the restart time control value when the determining unit determines that the restart of the sub control unit is an abnormal restart.

7. The image forming apparatus according to claim 1, further comprising a peripheral circuit of the sub control unit, wherein the sub control unit does not restart the peripheral circuit when the determining unit determines that the restart of the sub control unit is an abnormal restart.

8. The image forming apparatus according to claim 1, wherein the electric load is a charging unit for the image formation, and the sub control unit decreases a voltage to be generated by the voltage applying unit when the determining unit determines that the restart of the sub control unit is an abnormal restart.

9. The image forming apparatus according to claim 8, further comprising an abnormal discharge detecting unit for periodically checking abnormal discharge caused when the generated voltage is applied to the charging unit, wherein the sub control unit shortens a detection cycle for the abnormal discharge detecting unit when the determining unit determines that the restart of the sub control unit is an abnormal restart.

10. The image forming apparatus according to claim 1, further comprising a reporting unit for reporting a method for removing a cause of the abnormal restart when the determining unit determines that the restart of the sub control unit is an abnormal restart.

11. The image forming apparatus according to claim 1, further comprising a power supply shared by the sub control unit and a peripheral circuit of the sub control unit, wherein the main control unit disconnects the power supply when the determining unit determines that the restart of the sub control unit is not an abnormal restart.

12. A voltage applying device, comprising:

a voltage applying unit for generating a voltage and applying the generated voltage to an electric load;

a sub control unit for controlling an operation of the voltage applying unit;

a restarting unit for restarting the sub control unit in response to receipt of a restart signal;

a main control unit for generating a control start signal for allowing the voltage applying unit to start generation of a voltage and sending the generated control start signal to the sub control unit, and for generating the restart signal and sending the generated restart signal to the restarting unit; and a determining unit for determining whether or not a restart of the sub control unit is an abnormal restart, wherein the main control unit sends again the control start signal to the sub control unit when the determining unit determines that the restart of the sub control unit is an abnormal restart.

13. The voltage applying device according to claim 12, further comprising a voltage detecting unit for detecting a voltage output from the voltage applying unit, wherein the determining unit determines that the restart of the sub control unit is an abnormal restart when a restart time voltage detected by the voltage detecting unit after the sub control unit is restarted by the restarting unit has a value other than zero.

14. The voltage applying device according to claim 13, wherein the sub control unit sets a temporary voltage for the voltage applying unit on the basis of the restart time voltage when the determining unit determines that the restart of the sub control unit is an abnormal restart.

15. The voltage applying device according to claim 12, wherein the sub control unit generates a control value for controlling the operation of the voltage applying unit, and the sub control unit sets the generated control value to a predetermined value when the determining unit determines that the restart of the sub control unit is an abnormal restart.

16. The voltage applying device according to claim 12, wherein the sub control unit generates a control value for controlling the operation of the voltage applying unit, the voltage applying device further comprises a control value detecting unit for detecting the control value, and the determining unit determines that the restart of the sub control unit is an abnormal restart when a restart time control value detected by the control value detecting unit after the sub control unit is restarted by the restarting unit is a value other than zero.

17. The voltage applying device according to claim 16, wherein the sub control unit sets the generated control value to the restart time control value when the determining unit determines that the restart of the sub control unit is an abnormal restart.

* * * * *